US009340343B2

(12) United States Patent
Ramirez et al.

(10) Patent No.: US 9,340,343 B2
(45) Date of Patent: May 17, 2016

(54) EGG CARTON WITH MATING CELL AND LID POST STRUCTURE

(75) Inventors: Richard L. Ramirez, Lawrenceville, GA (US); Mark A. Bergeron, Monroe, GA (US); Roger P. Lichtle, Decatur, IN (US)

(73) Assignee: Tekni-Plex, Inc., Wayne, PA (US)

( * ) Notice: Subject to any disclaimer, the term of this patent is extended or adjusted under 35 U.S.C. 154(b) by 17 days.

(21) Appl. No.: 13/219,083

(22) Filed: Aug. 26, 2011

(65) Prior Publication Data

US 2013/0048527 A1 Feb. 28, 2013

(51) Int. Cl.

| | |
|---|---|
| ***B65D 77/04*** | (2006.01) |
| ***B65D 85/32*** | (2006.01) |
| ***B65D 71/00*** | (2006.01) |
| *B65B 35/50* | (2006.01) |

(52) U.S. Cl.

CPC ..... *B65D 77/046* (2013.01); *B65D 71/0096* (2013.01); *B65D 77/0433* (2013.01); *B65D 85/32* (2013.01); *B65B 35/50* (2013.01); *B65D 2571/00043* (2013.01); *B65D 2577/047* (2013.01)

(58) Field of Classification Search

CPC ..... B65D 85/32–85/328
USPC ..... 206/521, 521.1, 521.8
See application file for complete search history.

(56) References Cited

U.S. PATENT DOCUMENTS

| | | | | | |
|---|---|---|---|---|---|
| 2,591,446 | A | * | 4/1952 | Lennon | 206/521.8 |
| 2,600,130 | A | * | 6/1952 | Schilling | 206/521.8 |
| 2,939,602 | A | * | 6/1960 | Grant | 217/26.5 |
| 3,362,605 | A | * | 1/1968 | Bixler | 206/521.1 |
| 3,920,178 | A | | 11/1975 | Moller | |
| 4,025,038 | A | * | 5/1977 | Reifers et al. | 206/521.1 |
| 4,492,331 | A | * | 1/1985 | Bixler et al. | 206/521.1 |
| 4,795,080 | A | * | 1/1989 | McIntyre | 206/521.1 |
| D306,138 | S | | 2/1990 | Congleton et al. | |
| D307,387 | S | | 4/1990 | Payne et al. | |
| D308,822 | S | | 6/1990 | Congleton | |
| 5,494,164 | A | | 2/1996 | Ramirez | |
| 6,012,583 | A | | 1/2000 | Ramirez | |
| D506,932 | S | | 7/2005 | Ramirez | |

OTHER PUBLICATIONS

English Translation of the Requirements Stated by the Examiner in Mexican Patent Appln. No. MX/A/2012/009813.

* cited by examiner

*Primary Examiner* — Anthony Stashick
*Assistant Examiner* — Mollie Llewellyn
(74) *Attorney, Agent, or Firm* — Therese A. Hendricks

(57) ABSTRACT

Plastic egg cartons having mating cell and lid posts for improved egg protection. The carton has a base tray and hinged lid, the tray including a plurality of cells for receiving individual eggs, and the tray having a plurality of cell posts each formed at an intersection of four adjacent cells as an extension of the sidewalls of the four adjacent cells. Preferable, each cell post has four generally planar ramp surfaces, one disposed respectively on each of the four sidewall extensions. The lid has a plurality of lid posts for mating with the cell posts when the lid is in a closed position.

15 Claims, 10 Drawing Sheets

EGG CARTON WITH MATING CELL AND LID POST STRUCTURE

FIELD OF THE INVENTION

The present invention relates to plastic egg cartons and more particularly to an egg carton having mating cell and lid posts for improved egg protection.

BACKGROUND

Many factors are taken into consideration in the design of egg cartons. Egg protection, resistance to stress or force, stackability, transportability, moisture resistance, aesthetic appearance, print surface area, weight, nestability/detestability, adaptability to accommodate various size eggs, and consistent manufacturing are factors which may be considered to varying degrees in the design of an egg carton.

Filled egg cartons are subjected to multiple adverse mechanical forces and environmental conditions during handling and transport from distribution centers to store shelves, and then from store shelves to consumer homes. They typically encounter automated equipment for packaging, loading, unloading, stacking, restacking and transport. During each of these encounters the goal is to resist egg breakage by stabilizing and holding the eggs in a protected environment, in a carton that can be manufactured in a cost effective manner.

Pulp (paper) egg cartons are stiff and rigid when dry, i.e., under low humidity conditions. However, after being moved in and out of refrigeration, or with a change in the weather, pulp cartons become soggy and do not retain their shape. The dimensional stability of the cell pocket structure is lost. Also, because pulp cartons tend to have very stiff locking flaps and hinges, this creates closing and handling issues for the egg processors. Often, the lid does not line up with the base tray due to the stiff hinge, resulting in cartons which are not level in the closed position. Both problems lead to excessive loading, defective protection and egg breakage issues.

Plastic egg cartons have been provided with flexible walls between the cell pockets to protect the eggs and stop the eggs from going into adjacent cell pockets. However, during handling, such as loading cases (groups of stacked egg cartons) onto a grocery pallet, and stacking the cases 5 to 6 high on the pallet, and/or while being thrown onto the pallets and bumping into each other, the cartons are subjected to considerable compressive and lateral impact forces. The eggs can come out of their cell pockets and make contact from a hard side impact blow. Also, when scanning bar codes on lid tops, the eggs can be displaced and make contact.

Thus, there is need for an improved egg carton construction to provide better egg protection while encountering the adverse mechanical forces and environmental changes that typically occur during packaging, transportation and storage.

SUMMARY OF THE INVENTION

The present invention relates to an improved plastic egg carton having one or more structural features that increase its compressive strength and/or resistance to side impact loads. This results in better egg protection, and less breakage. Due to its greater strength, the carton can also be adapted to hold larger sized (e.g., jumbo) eggs without requiring a corresponding increase in the footprint (overall size) of the carton. This provides advantages such as less material costs, use of existing (standard size) containers, and/or more cost efficient transport (e.g., shipping less air).

In one embodiment, an improved cell pocket structure is provided on the base tray and lid of a plastic egg carton. A cell post is formed at an intersection (i.e., cross-hair (+)) of four adjacent (2×2 matrix of) cells in the base tray, the cell post comprising an extension of the intersecting sidewalls of the four cells and extending above the peripheral edge of the base tray of the carton. The cell post has four generally planar ramp surfaces, one disposed on each of the four sidewall extensions. A lid, hingedly connected to the tray, has an interior lid post extending downwardly toward the tray for mating with the cell post when the lid is closed. Preferably, the lid post also includes complimentary ramp surfaces for mating with the planar ramp surfaces of the cell post when the lid is closed. As used herein, "mating" means adapted to respectively contact or be disposed in close proximity to; actual contact between the mating surfaces may occur whenever the lid and base tray are in a closed position, or only when in a closed position and an additional force is applied to the carton, e.g., when stacking the cartons one on top of another and/or stacking side by side and/or moving the cartons.

In one embodiment, the lid post comprises four downwardly extending fingers each having one of the complimentary ramp surfaces and adapted to respectively contact or be disposed in close proximity to the four ramp surfaces of the cell post when the tray and lid are in a closed position. The mating planar ramp surfaces of the cell and lid posts increase the top compressive strength of the carton, and/or resistance to side load impacts. Still further, the ramps can help align the eggs as they are deposited (dropped) into the individual cell pockets from above, e.g., by an automatic egg loader.

The mating cell and lid posts are preferably provided at the intersection of every four cell (2×2 cell matrix) in the base tray and lid.

In one embodiment, a plastic egg carton is provided comprising:

a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a sidewall extending upwardly from the bottom to form a corresponding one of the cells;

the tray having a plurality of cell posts extending upwardly toward the lid above the peripheral edge of the tray, each cell post being formed at an intersection of four adjacent cells as an extension of the sidewalls of the four adjacent cells;

each cell post having four generally planar ramp surfaces, one disposed respectively on each of the four sidewall extensions; and, the lid having a plurality of lid posts, each lid post extending downwardly toward the tray and having a surface for mating with the cell post when the lid is in the closed position.

In one embodiment, the lid post includes complementary ramp surfaces for mating with the ramp surfaces of the cell post when the lid is in the closed position.

In one embodiment, the lid post includes four downwardly extending fingers, each finger having one of the complementary ramp surfaces.

In one embodiment, the cell post has a central dome and wherein the lid post has a complementary crown adapted to receive the dome when the lid is in the closed position.

In one embodiment, the lid post has four contoured surfaces, one between each pair of adjacent fingers, for mating with eggs received within the four adjacent cells when the lid is in the closed position.

In one embodiment, the lid includes a connecting wall between each pair of adjacent lid posts, the connecting wall including a pair of partial ovoid shaped depressions for mating with eggs received in the adjacent cells.

In one embodiment, the cell post has a central axis aligned with the height of the carton, and the cell post ramp surfaces are disposed at an angle of from about 20 to about 45 degrees relative to the axis of the cell post.

In one embodiment, the ramp angle is from about 30 to about 45 degrees.

In one embodiment, the ramp angle is from about 35 to about 45 degrees.

In one embodiment, the lid post includes four downwardly extending fingers, each finger having a complementary ramp surface for mating with one of the respective ramp surfaces of the cell post, and the lid post having four contoured surfaces, one between each pair of adjacent fingers, for mating with eggs received within the four adjacent cells when the lid is in the closed position.

In one embodiment, the cell post has a central dome and wherein the lid post has a complementary crown adapted to receive the dome when the lid is in the closed position.

In one embodiment, the cell post has a central axis aligned with the height of the carton, and the cell post ramp surfaces are disposed at an angle of from about 20 to about 45 degrees relative to the axis of the cell post, and each lid post includes four downwardly extending fingers, each finger having a complementary ramp surface to engage one of the respective ramp surfaces of the cell post when the lid is in the closed position.

In one embodiment, the lid post has four contoured surfaces, one between each pair of adjacent fingers, for mating with eggs received within the four adjacent cells when the lid is in the closed position.

In one embodiment, the lid includes a connecting wall between each pair of adjacent lid posts, the connecting wall including a pair of partial ovoid shaped depressions for mating with eggs received in the adjacent cells.

In one embodiment, the egg carton comprises one of a 2×3, 2×4, 2×5, 2×6, 3×3, 3×4, 3×5, 3×6, 4×4, 4×5, 4×6, 5×5, 5×6 or 6×6 matrix of the cells.

In another embodiment, a plastic egg carton is provided comprising:

a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a sidewall extending upwardly from the bottom to form a corresponding one of the cells;

the tray having a plurality of cell posts extending above the peripheral edge of the tray, each cell post being formed at an intersection of four adjacent cells as a central dome and an extension of the sidewalls of the four adjacent cells; and the lid having a plurality of lid posts, each lid post having a complementary crown adapted to receive the cell post dome and having four fingers extending downwardly from the crown for mating with the four sidewalk extensions of the cell post respectively when the lid is in the closed position.

In one embodiment, the cell post has four generally planar ramp surfaces, one disposed respectively on each of the four sidewall extensions, and each finger of the lid post includes a complementary ramp surface for mating with the ramp surface of the cell post when the lid is in the closed position.

In one embodiment, the four contoured surfaces, one between each pair of adjacent fingers, are provided for mating with eggs received within the four adjacent cells when the lid is in the closed position.

In one embodiment, the cell post has a central axis aligned with the height of the carton, and the cell post ramp surfaces are disposed at an angle of from about 20 to about 45 degrees relative to the axis of the cell post.

In one embodiment, the ramp angle is from about 30 to about 45 degrees.

In one embodiment, the ramp angle is from about 35 to about 45 degrees.

In one embodiment, the egg cartons are arranged in a stack.

In one embodiment, a container is provided for holding the stack.

In one embodiment, the container holds a full case or half case of egg cartons.

In another embodiment, a method is provided for stacking plastic egg cartons on top of one another, each egg carton having a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a sidewall extending upwardly from the bottom to form a corresponding one of the cells;

the tray having a plurality of cell posts, each formed at an intersection of four adjacent cells as an extension of the sidewalls of the four adjacent cells and extending upwardly toward the lid above the peripheral edge of the tray;

each cell post having four generally planar ramp surfaces, one disposed respectively on each of the four sidewall extensions; and, the lid having a plurality of lid posts, each extending downwardly toward the tray and having a surface for mating with the cell post when the lid is in the closed position, the method comprising steps of:

filling the cells of each egg carton with eggs, closing the lids, and stacking the filled closed egg cartons on top of one another.

In another embodiment, a method is provided for stacking the plastic egg cartons on top of one another, each egg carton having a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a sidewall extending upwardly from the bottom to form a corresponding one of the cells;

the tray having a plurality of cell posts, each cell post formed at an intersection of four adjacent cells as an extension of the sidewalls of the four adjacent cells and having a central dome extending above the peripheral edge of the tray, the lid having a plurality of lid posts, each lid post having a complementary crown adapted to receive the cell post dome and having four fingers extending downwardly from the crown, each finger for mating with one of the four sidewall extensions of the cell post when the lid is in the closed position;

the method comprising steps of:

filling the cells of each egg carton with eggs, closing the lids, and stacking the filled closed egg cartons on top of one another.

BRIEF DESCRIPTION OF THE DRAWINGS

The drawings depict various embodiments of the invention wherein.

DETAILED DESCRIPTION

FIGS. 1-5 illustrate one embodiment of the invention, a 2×6 matrix plastic egg carton with mating cell and lid posts. The carton has cell pockets sized to hold up to a jumbo egg, between about 2.50 and about 2.75 ounces, while the carton occupies no more than a standard (non-jumbo) egg carton footprint. The invention is not limited to such standard footprint egg cartons, for jumbo eggs; rather the mating lid and cell post structure can be used with substantially any cell and carton size, for holding any size eggs, where the overall carton dimensions are not limited. The increased strength of the mating lid and cell post structure is useful for various purposes in addition to improved egg protection, including light-weighting of the carton (saving material costs), the use of alternative materials or manufacturing processes, increasing the stacking height, etc.

FIGS. 6-9 illustrate a second embodiment of the invention, similar to the first, and designed to hold jumbo eggs in a 3×6 matrix. Again, this is a non-limiting example.

Figure 1:
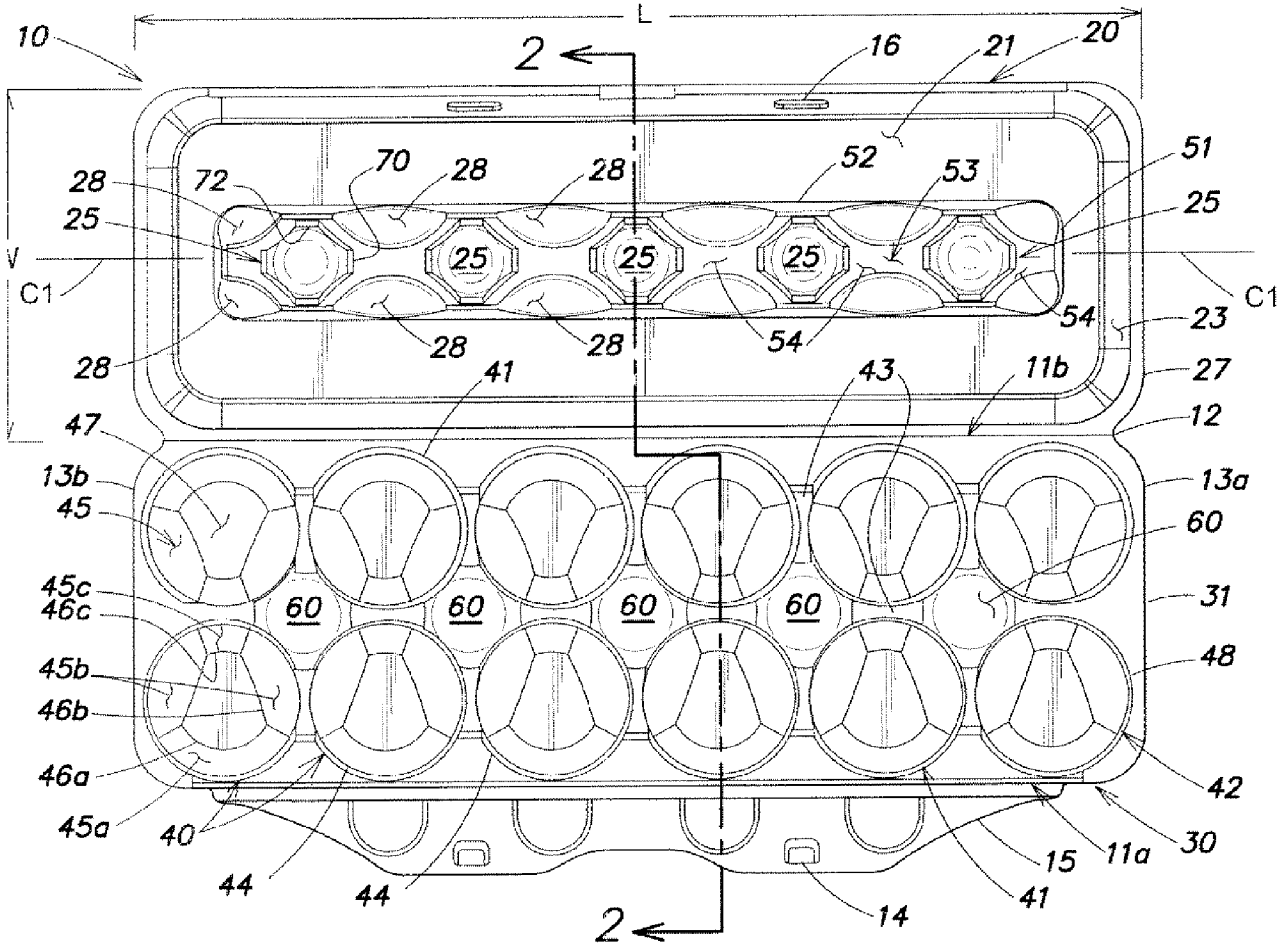
FIG. 1 is a top plan view of an egg carton according to one embodiment of the invention, showing the hinged lid and the bottom tray portions in an open position, and the bottom tray portion comprising a 2×6 matrix of egg receiving cells.

FIG. 1 shows in top plan view the interior of an open 2×6 matrix egg carton 10 according to one embodiment of the invention. When closed (see FIG. 3) the carton 10 occupies a volume having a length L, width W, and height H. The carton is comprised of a lid 20 connected via a hinge 12 to a base tray 30, the tray comprising a plurality of egg receiving cells 40 arranged in the 2×6 matrix. The matrix includes four corner cells 42, one at each corner of the carton, and eight edge cells 41, with four edge cells extending along each of the two opposing longitudinal edges 11*a*, 11*b* of the carton, between the corner cells. At each cross-hair (+) intersection of four adjacent cells (2×2 matrix), a cell post 60 is provided. Each cell is configured to have a contour (shape and dimensions) complementary to the shape of an egg 4 (shown in dashed lines in FIG. 2). As used herein "complementary" means conforming at least in part to the contour (size and shape) of the egg being held or the surface being mated with. It is contemplated that various sized eggs can be inserted into a cell, in one or both of an oriented and non-oriented direction.

In the present embodiment, the carton 10 is integrally molded from a sheet of thermoplastic material, here polystyrene foam, which sheet is formed into an end product (carton) having the structural components described herein via conventional molding processes, e.g., pressing the polystyrene foam sheet between male and female dies to form shaped lid and base portions and then removing (trimming) any remaining portions of the sheet to form an integral carton. The formation and structure of components such as the hinge 12, lid flap 15, and base-locking nubs 14 and associated locking apertures 16, are shown and described in the prior art such as in U.S. Pat. Nos. 6,012,583 and 5,494,164, the entire disclosures of which are incorporated herein by reference as if fully set forth herein.

Figure 2:
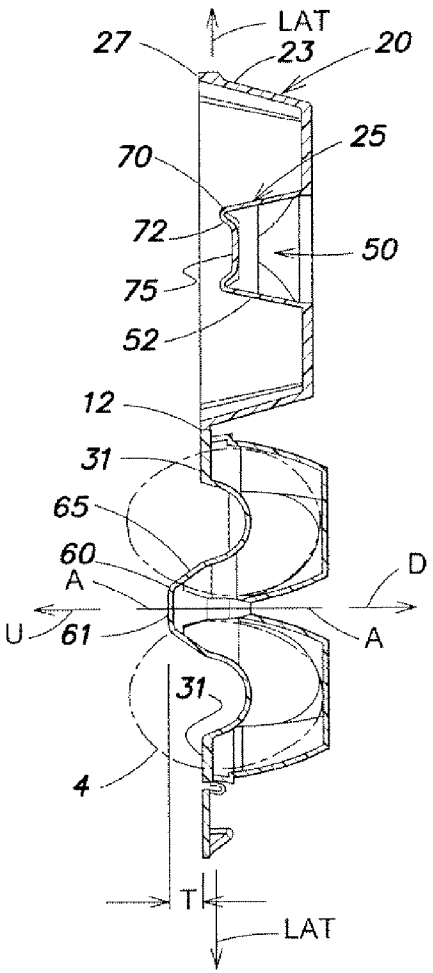
FIG. 2 is a lateral sectional view taken along lines 2-2 of FIG. 1.

As shown in FIGS. 1-2, the lid 20 has a generally flat (planar) uppermost top wall 21 and a surrounding downwardly extending peripheral sidewall 23 which has a peripheral lower edge 27 that mates with a peripheral upper edge 31 of the tray. The lid has a plurality of lid posts 25 projecting axially A downwardly D toward the tray 30 and disposed along a centerline C1 of the longitudinal length L of the lid 20. The five (5) downwardly D projecting lid posts 25 are each arranged to mate with one each of the five (5) cell posts 60 of the tray 30.

A trough 50 is also formed within the body of the lid 20, as a generally elongated rectangular depression within the body of the planar top wall 21 and peripheral sidewall 23, the trough having opposing longitudinal side walls 52 and opposing lateral end walls 51 that extend axially A downwardly D and below the planar top wall 21 of the lid 20. As shown, the lid posts 25 project further downwardly D from a bottom wall 53 of the trough 50. The bottom wall 53 includes a connecting wall portion 54 between each pair of adjacent lid posts 25, and between each of the two end lid posts and lateral edges 51 of the trough respectively.

The lid further includes contoured (partial ovoid shaped) portions 28 forming an upper part of the cell pocket structure for securing/protecting the eggs in the cell pockets. The contoured portions 28 are disposed between each pair of adjacent lid posts, and between each lateral end lid post and lateral trough end wall 51. The ovoid-shaped contoured portion 28, disposed on opposing sides of a centerline C1 aligned with the central axis of each lid post, are located and shaped to mate with eggs in the cells on opposing sides of the centerline C1.

Figure 3:
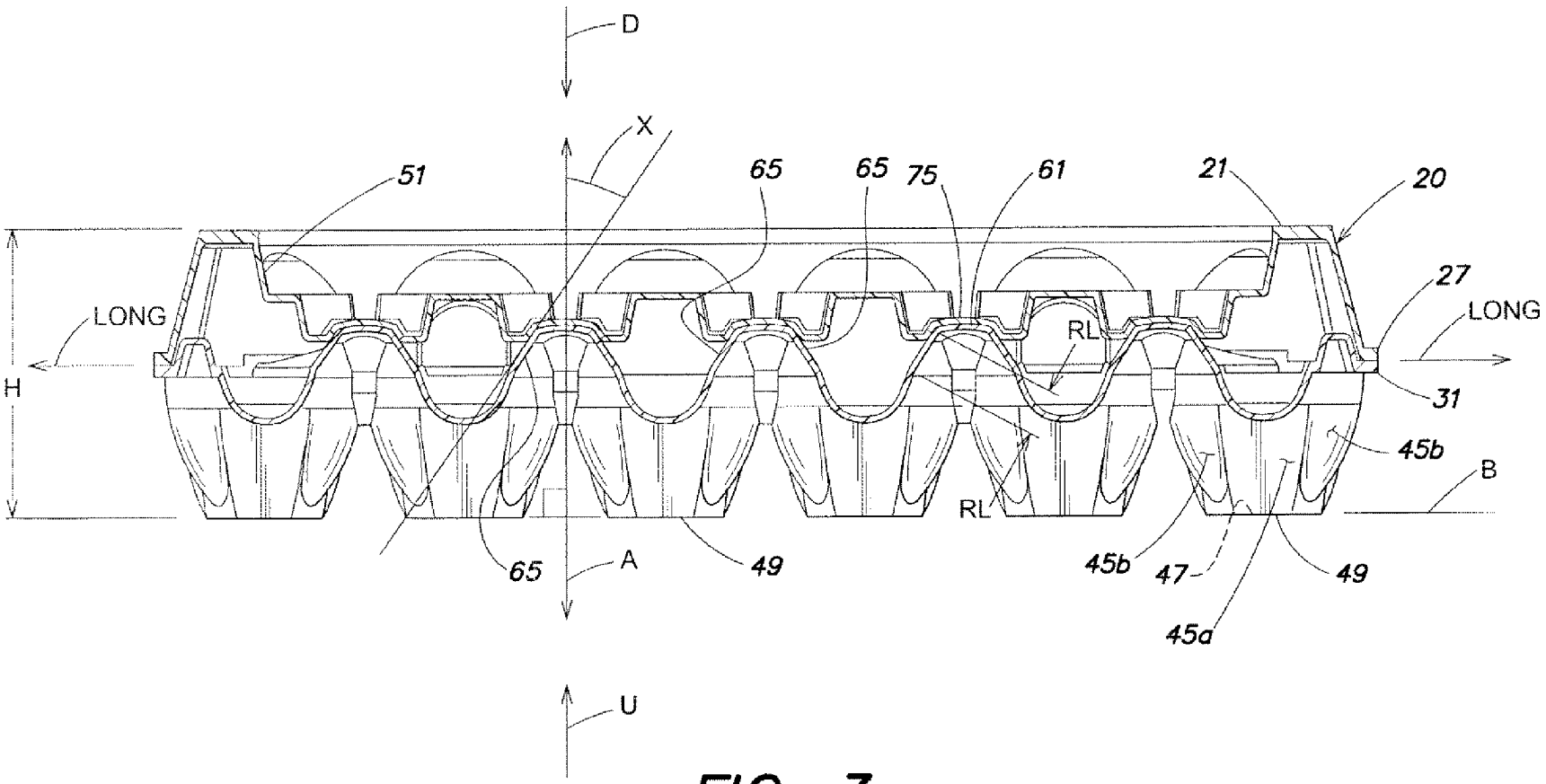
FIG. 3 is a longitudinal sectional view of the FIG. 1 embodiment with the lid and the tray in a closed position.
Figure 4:
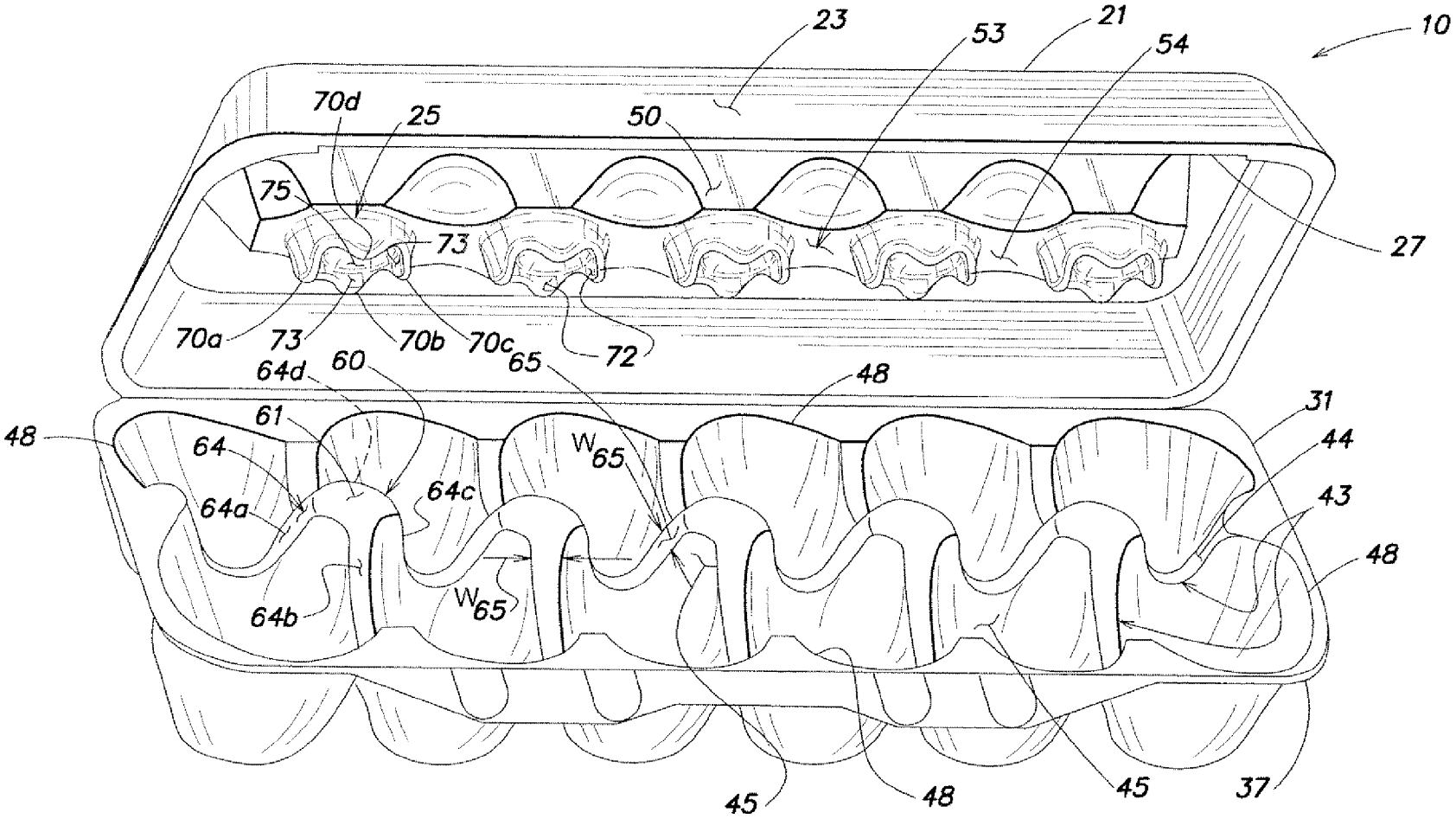
FIG. 4 is a top perspective view of the FIG. 1 egg carton with the lid and tray in a partially open position, showing the interior of the carton and the contours of the cell pockets, cell posts and lid posts.

As shown in FIGS. 1 and 4, the tray portion 30 of the carton 10 comprises a linear matrix of egg-receiving cells 40, aligned along rows and/or columns of the cell matrix, each cell being formed to receive and accommodate a single egg. Each cell 40 has a sidewall 45 having an inner receiving surface contoured to receive the ovoid shape of an egg. The sidewall 45 extends upwardly from a bottom cell wall 47 (see FIG. 3) to define an open top end of the cell. Two adjourning sidewalls 45, 45, between adjacent pairs of cells 40, cooperatively define a cell junction 43. The cell junction 43 preferably includes a rounded upper shoulder portion forming a top edge 48 of the joined sidewalls. The sidewalls 45 are generally flexible to respond to pressure applied during packaging, transportation and/or storage of the eggs.

As show in FIG. 3, sidewall 45 extends upwardly from a cell base wall 47 in the direction of the lid 20. The cells collectively form the base tray 30 such that at least some area of the bottom surfaces 49 of all of the cells of one carton are substantially co-planar to lie substantially within a common plane B. This allows the planar bottom of one carton to be mechanically stacked or deposited on top of the uppermost planar lid surfaces 21 of another carton (see FIGS. 10-11). By force of gravity, the bottom surfaces 49 bear against the top surface 21 to provide a degree of stability against lateral LAT or longitudinal LONG movement due to friction between the top surface 21 and bottom surface 49.

In the first embodiment of FIG. 1, the cell 40 has a generally triangular-shaped cell bottom wall 47, including a curved outermost edge 46*a* disposed adjacent a longitudinal edge 11*a* or 11*b* of the carton. The other two generally straight edges 46*b* of the bottom wall come together to form at their opposing ends a rounded (truncated) third corner 46*c* of the triangle. The cell sidewall 45 has sidewall portions a, b, and c which extend upwardly from and generally continue the triangular shape of the base well. More specifically, the sidewall 45 includes: 1) an outwardly curved sidewall portion 45*a* extending from the curved bottom edge 46*a*, having substantially the same curvature as edge 46*a* and gradually increasing in circumferential length moving upwardly toward the top edge 48 of the cell wall; 2) extending from each of the linear side edges 46*b*, 46*b* of the triangular bottom, are outwardly curved sidewall portions 45*b*, 45*b* that gradually increase in circumferential length moving toward the top edge 48 of the cell wall; and 3) extending upwardly from the rounded third corner 46*c* of the triangular bottom, a fourth sidewall portion 45*c* also has a similar rounded contour increasing in length toward the top of the cell wall. The triangular cell bottom and sculpted sidewall surfaces shown in this first embodiment provide improved egg protection by securing the eggs within an individual cell pocket compartment. The cell contour is designed to handle both oriented and non-oriented eggs.

At each intersection of four adjacent (2×2 matrix of) cells within the tray 30, a cell post 60 is formed as an extension of the merged sidewalls 45 of the four adjacent cells 40. The cell post 60 has a central dome 61 extending axially A by a selected distance T (see FIG. 2) above the upper peripheral edge 31 of the base tray 30. Typically the dome 61 extends a distance of about 0.30 to about 0.50 inches above the upper periphery 31 of the tray 30, the peripheral edge 31 providing a mating surface for the lower peripheral edge 27 of the lid 20. The cell post 60 includes four sidewall extensions 64 arranged in a cross-hair (+) configuration and extending upwardly from the intersecting sidewalls 45 between each pair of the four adjacent cells, i.e., each pair of adjacent cells have sidewalls that merge to form one of the sidewall extensions 64*a, b, c, d* (see FIG. 4). Preferably, each sidewall extension 64 has a substantially planar ramp surface 65 (see FIGS. 2 and 4-5) preferably forming an uppermost and widest portion $W_{65}$ (see FIG. 4) of the intersecting sidewalls 45 of the adjoining adjacent cells. While the cross-hair construction and planar ramps of the adjoining sidewall extensions 64 provide increased compression strength and help maintain the cell posts and lid posts in alignment, the individual sidewalls 45 can yield and flex to protectively hold the various sized eggs against breakage, particularly when exposed to lateral forces, In the present embodiment, the sidewall extensions 64 are dimensioned, in their relaxed state, to allow each cell to hold up to a jumbo size egg, without expanding the overall egg carton footprint (i.e., length L, width W and height H) of the carton beyond the standard footprint, that a non-jumbo cell size egg carton requires. This feature is described further below.

The planar ramp surfaces 65 of the sidewall extensions are preferably arranged and disposed at an angle X, as shown in FIG. 3, of from about 20 to about 45 degrees relative to the axis A aligned along the height H of the carton. The axis A of a cell post is a line that extends axially down the center of a cell post 60. The cell post is preferably generally tubular in shape and typically hollow. Typically, axis A is disposed laterally (at about 90 degrees) to the planar bottom B of the carton 10. The planar bottom B of the carton (see FIG. 3) lies in a plane that is generally coincident or coplanar with the bottom-most extending surfaces 49 on the underside of the egg cells 40 that comprise the tray 30. The ramp surfaces 65 extend between and form a portion of the wall adjoining adjacent cells at least along a certain length RL of intersecting walls 45 (see FIG. 3). The ramp surfaces 65 extend generally downwardly D from the base of the dome 61. The ramp surfaces 65 provide resistance at least in the axial direction A against downward compressive forces that may be exerted in the downward D direction by a lid post 25 bearing down against a cell post 60 when one carton is stacked on top of another. They also resist side impact forces and help maintain the lid and cell posts in axial alignment (i.e., the central axis of both the lid post and cell post are aligned).

Figure 5:
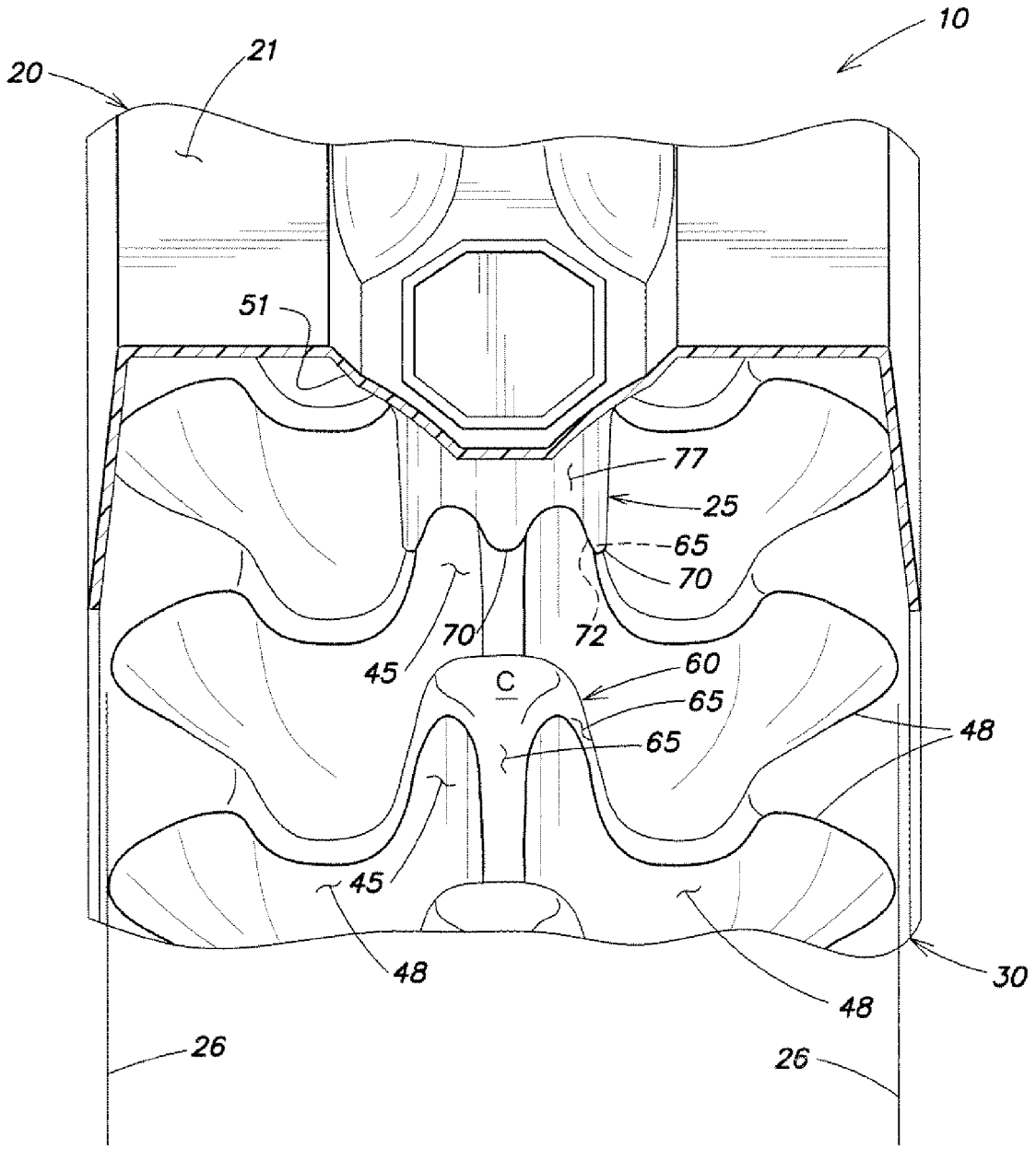
FIG. 5 is a top perspective, partial sectional view of the FIG. 1 egg carton with the lid partially cut-away and the lid and tray in a closed position, showing the contours of the lid post having downwardly projecting fingers engaging the sidewall extensions of the tray cell post.

As best shown in FIGS. 4-5, each lid post 25 comprises a downwardly projecting member having four downwardly projecting fingers 70 having inner surfaces 72. The four lid post fingers 70*a, b, c, d* are arranged in a cross-hair (+) configuration for mating with the four sidewall extensions 64 of a cell post. At the center of the lid post is a recessed crown 75 having a central interior pocket 76 adapted to receive the upwardly projecting dome 61 of the cell post when the lid 20 and tray 30 are in a closed position. The inner surfaces 72 of the fingers 70 are preferably configured to be complementary in contour with the sidewall extensions 64 of the cell post. More preferably, the inner surfaces of the lid post fingers have generally planar ramp surfaces 73 to mate with the ramp surfaces 65 of the cell post when the lid and tray are closed. Preferably, the outer surfaces 77 of the lid posts 25, between each pair of adjacent fingers have a recessed ovoid contour that is complementary to the outside surface of an egg deposited within a cell, and most preferably such that the outer surfaces 77 of the lid posts mate with the outside surface of an egg 4 to protect the egg against lateral LAT or longitudinal LONG movement within a cell when the lid 20 is closed down onto the tray 30.

The complementary lid and cell post ramp surfaces 73, 65 are adapted to engage when compressive forces are present, to resist such forces; as a result, the crown and dome need not actually engage. This helps prevent distortion of the cell post and lid post, which distortion may shift alignment of the lid and base tray and cause excessive loading on the eggs within the cell pockets, leading to egg breakage.

FIGS. 6-9 illustrate a second embodiment of the invention. The second embodiment is similar to the first, but here the egg carton is designed to hold jumbo eggs in a 3×6 matrix. For ease of reference, corresponding elements in the second embodiment are labeled with reference numbers in a 100 series (e.g., carton 10 in the first embodiment is carton 110 in the second embodiment).

Figure 6:
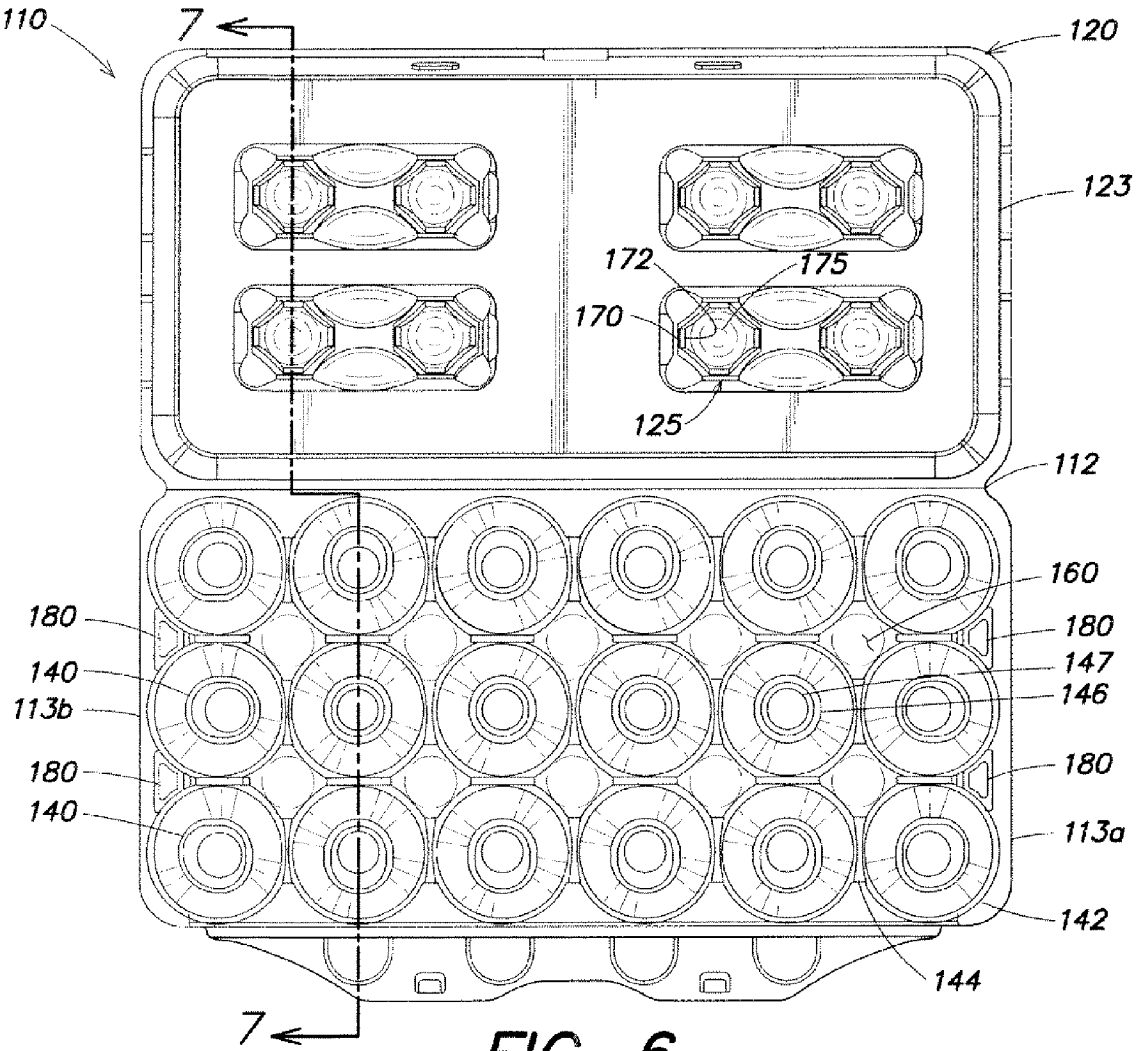
FIG. 6 is a top plan view of another embodiment of the invention, showing the hinged lid and tray in an open position, and the tray comprising a 3×6 matrix of egg receiving cells.

Similar to FIG. 4, FIG. 6 is a top prospective view of the egg carton 110 with the lid 120 and tray 130 in a partially open position, showing the interior of the carton and the contours of the cell pockets 140, cell posts 160 and lid posts 125. Another difference in the second embodiment is that the cell bottom walls are not triangular, but rather the bottom walls 147 are substantially circular, having a substantially circular outer edge 146. Also, the bottom wall is not flat but rather includes an outermost annular projecting edge ring 146*a*, forming the lowermost surface of the carton 110 which lies in bottom plane B. Radially inwardly of the outer annular ring is a push-up central bottom wall portion 146*b* and an oppositely disposed outwardly extending central dimple 146*c* which is contoured to receive one end of the egg 4 in the cell 140.

Following along the circular contour of the outer edge 146*a* of the bottom wall, the cell sidewall 145 is substantially conical, and increasing in diameter going upwardly toward the upper edge of the sidewall 148. This sidewall structure is adapted to form relatively thinner cell junctions between adjacent cells, compared to the cell junctions of the first embodiment. This allows the carton 110 to accommodate jumbo eggs in a 3×6 matrix wherein the carton footprint is no greater than a standard (non-jumbo) egg carton footprint for a 3×6 matrix. The relatively thinner sidewall junctions 164 (compared to the first embodiment) still include the generally planar ramp surfaces 165, 173 on the mating cell and lid posts. Otherwise, the structure of the first and second embodiments is substantially the same.

The second embodiment further includes a pair of opposing raised nubs or projections 180*a*, 180*b* disposed along the lateral sidewalls 113*a*, 113*b* of the base. The nubs preferably have a flat outer wall adapted to mate with the inner flat surface of the lid sidewall 123, to resist lateral movement of the lid on the base. Here, the pair of nubs 180*a*, 18*b* are disposed at opposing lateral ends of each row of cell posts. As a result of the nubs, lateral motion of the lid posts 125 and cell posts 160 is further reduced, assisting the posts in maintaining axial alignment. The nubs are optional and may be included in the 2×6 matrix of the first embodiment.

Figure 7:
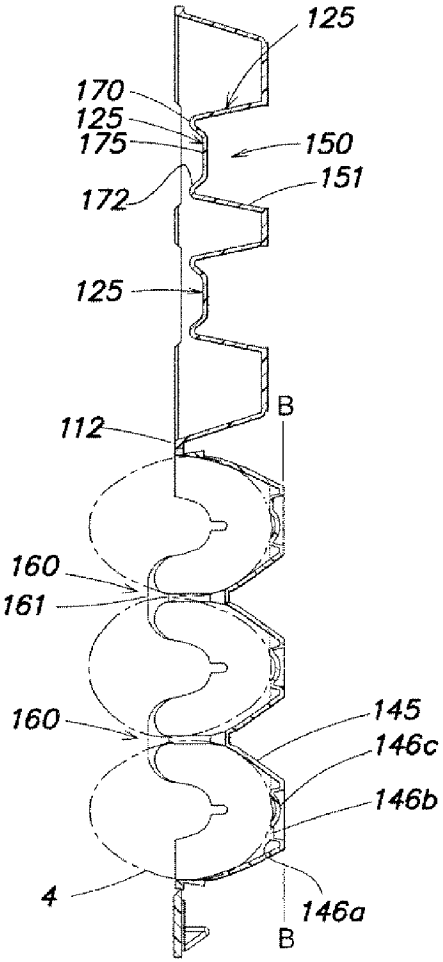
FIG. 7 is a lateral sectional view taken along lines 7-7 of FIG. 6.

FIG. 7 is a lateral sectional view, similar to FIG. 2, taken along the lines 7-7 of FIG. 6. Three eggs 4 are shown in dashed lines, resting in the three cells 140 extending laterally across the carton 110. Two lid posts 125 are shown in lid 130 for mating with the two cell posts 160 between each pair of adjacent cells 140.

Figure 8:
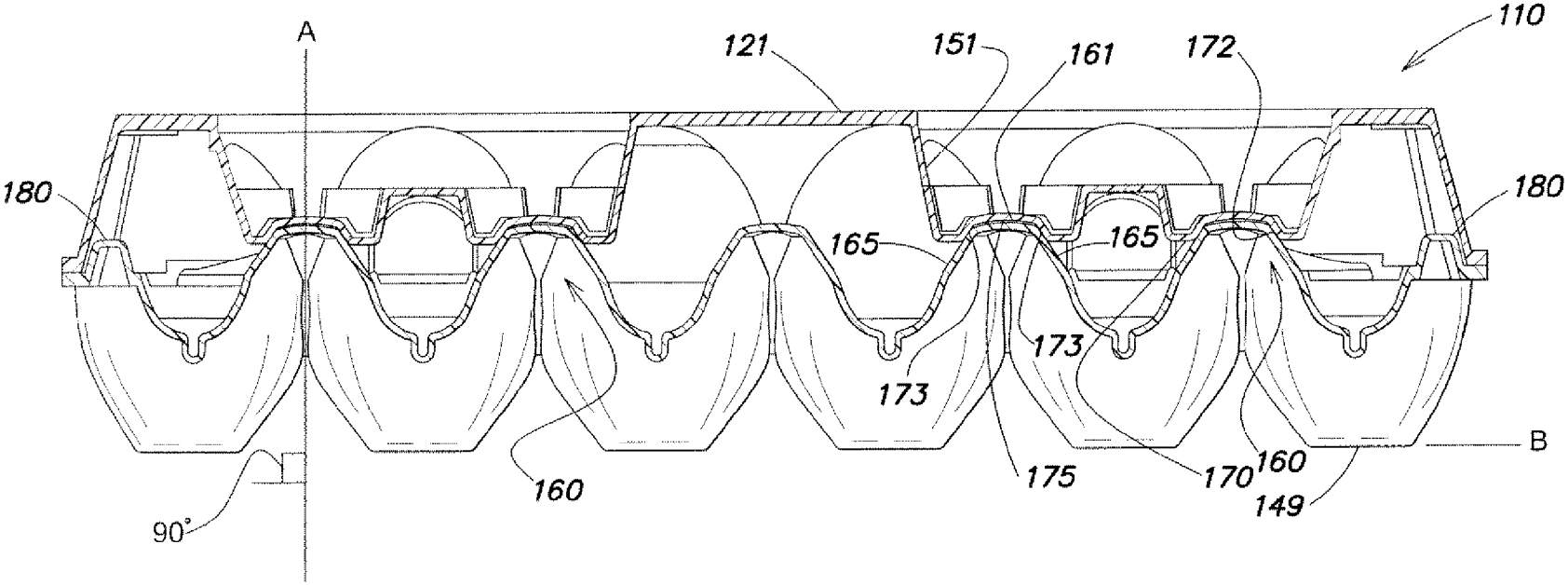
FIG. 8 is a longitudinal sectional view of the FIG. 6 egg carton with the lid and tray in a closed position.

FIG. 8 is similar to FIG. 3, showing a longitudinal sectional view of the lid and tray in a closed position. The bottom surfaces 149 of the cells lie in the plane B. The complementary planar ramp surfaces 165, 173 of the cell and lid posts 160, 125 are in engagement or are in close proximity thereto.

Figure 9:
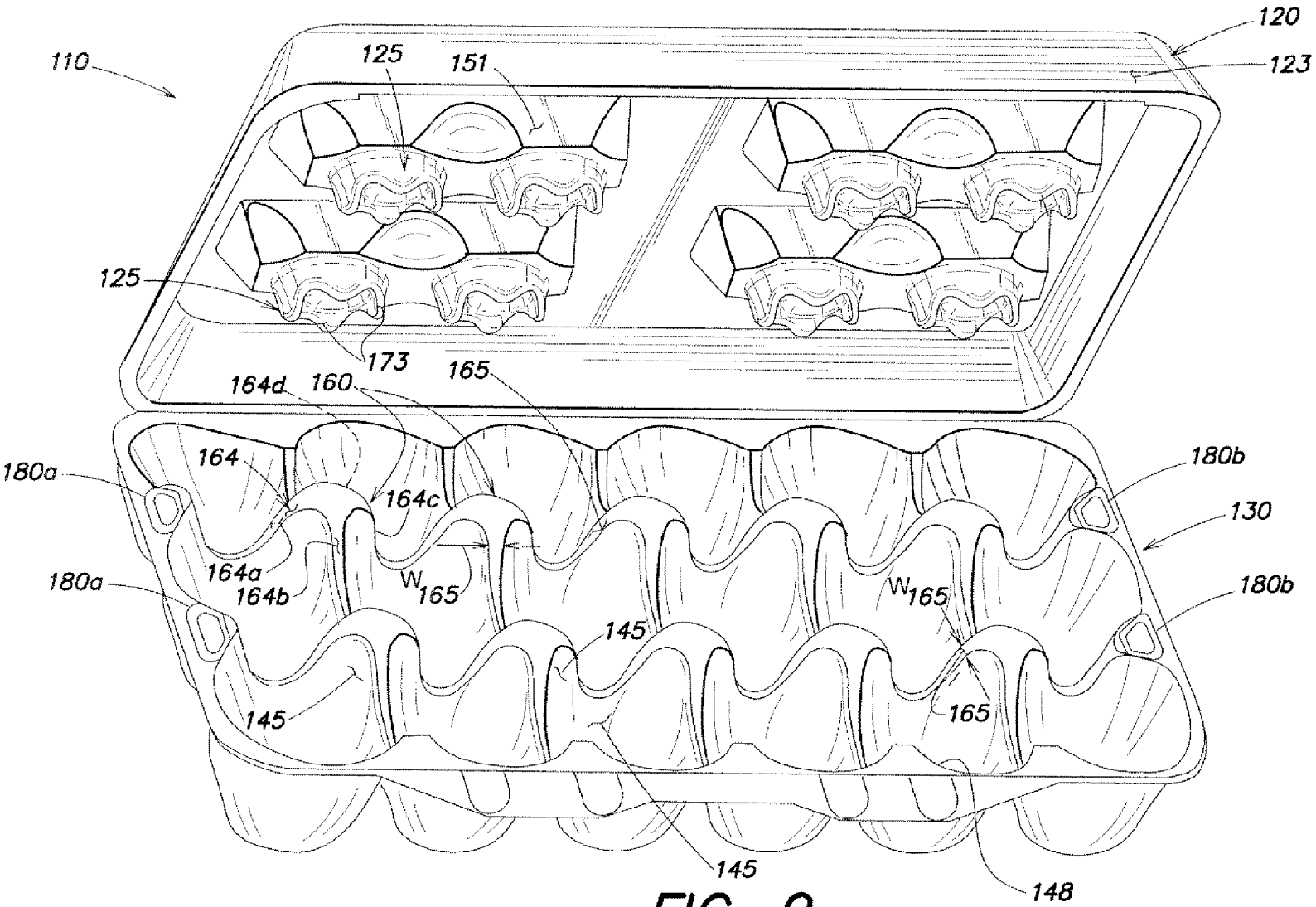
FIG. 9 is a top perspective view of the FIG. 6 egg carton with the lid and tray in a partially open position, showing the interior of the carton and the contours of the cell pockets, cell posts and lid posts.

FIG. 9 is top perspective view of the lid and tray in a partially open position, similar to FIG. 4. This figure best shows the surface contours of the mating cell and lid posts 160, 125.

In the second embodiment, the carton holds 18 jumbo eggs in a 3×6 matrix of cells and the overall carton has a length of between about 11.62 and about 11.75 inches, a width of between about 5.95 and about 6.00 inches, and a height of between about 2.62 and about 2.75 inches. This is the standard volume footprint of a 3×6 carton for non-jumbo eggs. Here, due to the increased strength provided by the mating cell and lid post structure, the standard footprint is maintained while accommodating jumbo eggs.

Similarly, in the first embodiment, the carton holds 12 jumbo eggs in 2×6 matrix of cells and has an overall length of between about 11.62 and about 11.75 inches, a width of between about 3.95 and about 4.00 inches, and a height of between about 2.62 and about 2.75 inches.

Figure 10:
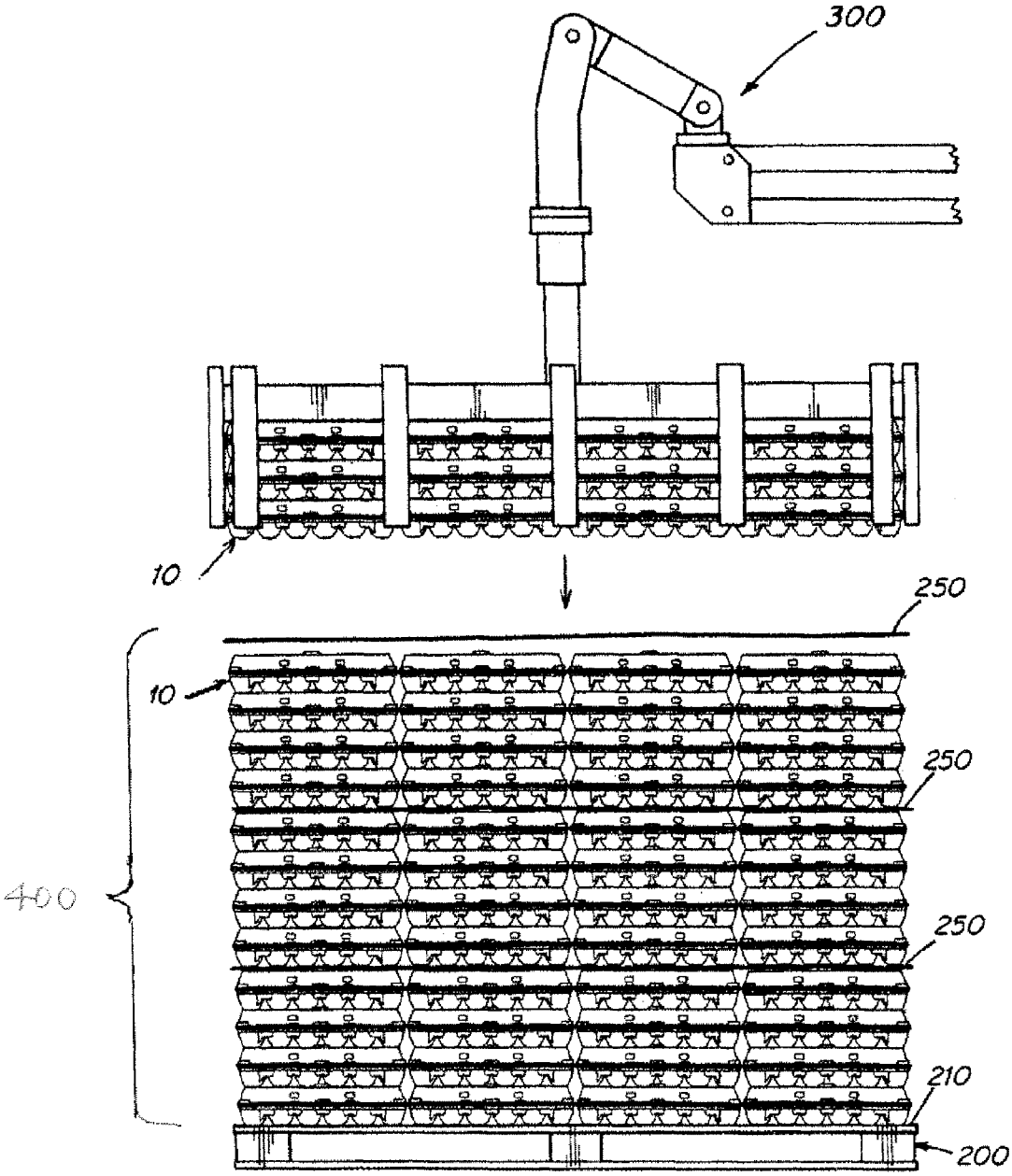
FIG. 10 is a side view of a pallet of stacked egg cartons showing a crane depositing another group of stacked cartons on top of the stack already on the pallet.

FIG. 10 shows one embodiment of a method and system for stacking a plurality of cartons 10. In this example the cartons are stacked on the top planar surface 210 of a pallet 200, typically by a forklift or crane 300. Here, the stacked cartons are shown not enclosed within outer containers. Alternatively, the cartons may be stacked within outer containers such as those shown in FIG. 11, and the containers stacked on top of one another. As shown in FIG. 10, the cartons 10 are stacked vertically in series in direct top to bottom contact, one on top of another, to form a stack 400. Slip sheets 250 are disposed between each substack of 4 cartons in vertical depth. The slip sheets 250 may comprise a flexible sheet of paper, plastic or cloth that can be deposited on and extended across the top surfaces of a horizontal layer of multiple side-by-side (horizontally arranged) cartons.

Figure 11A:
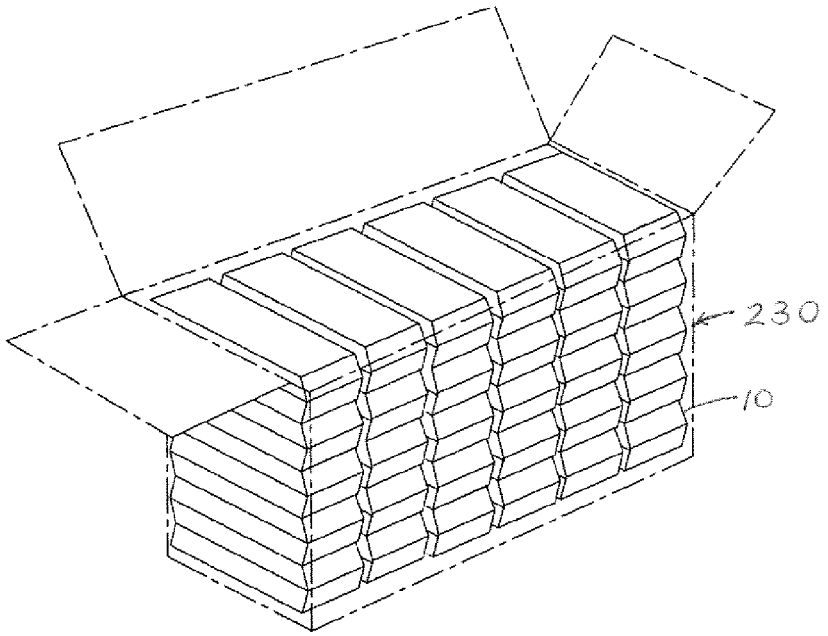
FIGS. 11A-D are perspective views of different stacking patterns of cartons packed in different types of containers.
Figure 11B:
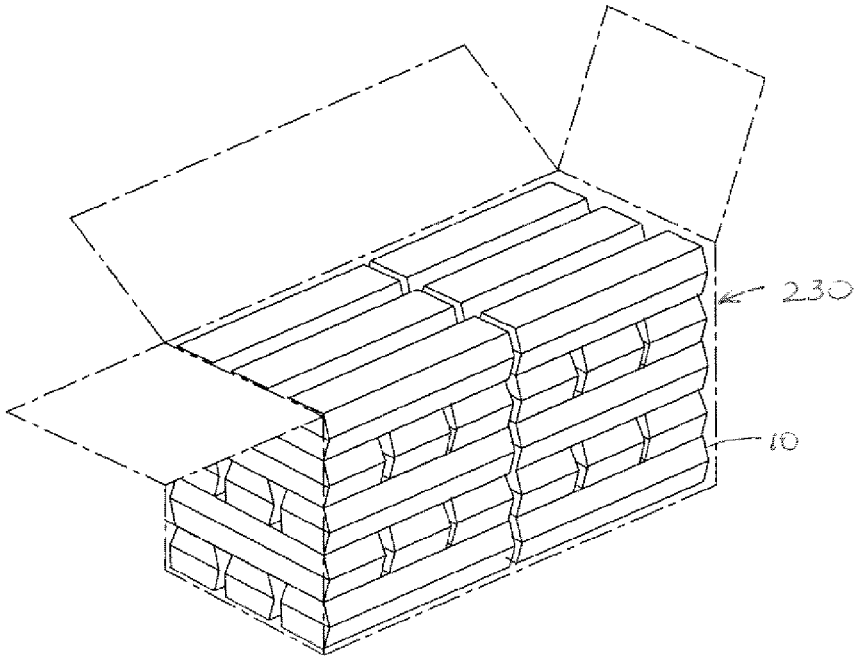

In other embodiments, the egg cartons are held (e.g., enclosed) in outer containers in various stacking patterns. FIG. 11A shows a full case rectilinear paperboard container 230 holding a 6×5 array of 30 2×6 egg cartons 10 stacked in parallel arrangement. The case 230 of FIG. 11A has inner dimensions of about: 23⅞ inches×11⅞ inches×13¾ inches. FIG. 11B shows the same full case container 230 holding 30 2×6 egg cartons 10 stacked in a cross stacking arrangement, wherein successive vertical layers are disposed transverse to the adjacent layer. Alternatively, a half case rectilinear container is provided to hold 15 2×6 egg cartons, in a 3×5 carton matrix. In one embodiment the 15-dozen half case container has inner dimensions of about: 11⅞ inches×11⅞ inches×13⅝ inches. In another embodiment, the 15-dozen half case container has inner dimensions of about: 12 inches×11⅞ inches×13½ inches.

In accordance with previously described embodiments of the invention, wherein a 2×6 egg carton is provided having a standard footprint but which accommodates jumbo size eggs, the above-described standard full case and half case containers can be used for jumbo size eggs, without increasing the dimensions of the full case or half case containers. Similarly, the 3×6 egg carton previously described can be accommodated in standard full and half case containers.

Figure 11C:
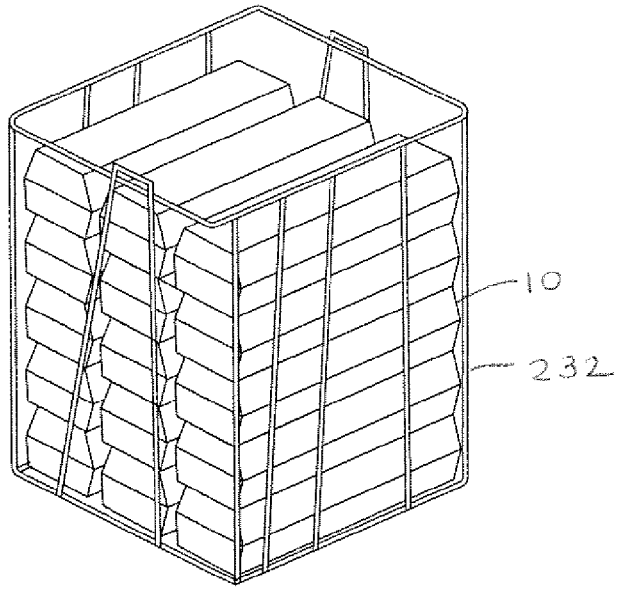
Figure 11D:
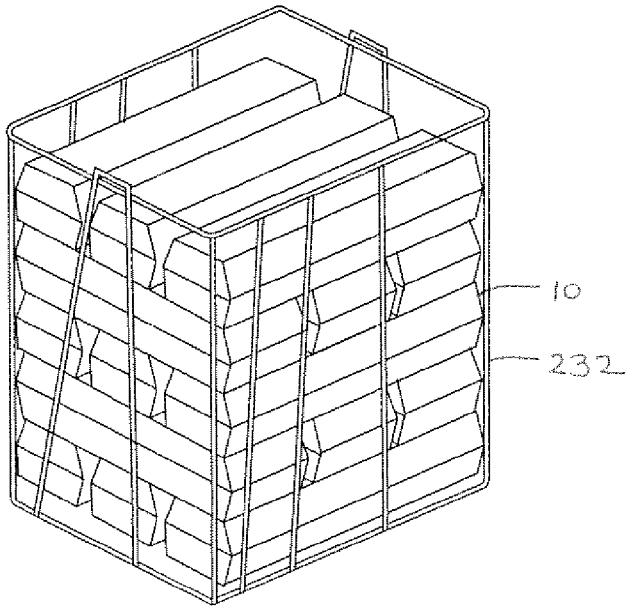

In alternative embodiments, the egg cartons 10 can be stacked in wire baskets 232. FIG. 11C shows parallel stacking of 15 2×6 matrix cartons in a wire basket 232. FIG. 11D shows cross stacking of 15 2×6 matrix cartons in the same wire basket.

In a further embodiment, a 24-dozen rectilinear case container, 2 cartons across in length, 3 cartons in width and 4 cartons in height, has inner dimensions of about: 23½ inches×11⅞ inches×11 inches.

In various embodiments, the plastic material of the egg carton is preferably one or more of polystyrene (e.g., polystyrene foam), polyester (e.g., polyethylene terephthalate (PET)), polyolefin (e.g., polyethylene (PE), polypropylene (PP)), or poly(lactic acid (PLA), including homopolymers, copolymers, mixtures and blends thereof, and including virgin and reclaimed (recycled) materials.

While specific embodiments of the present invention have been shown and described, it will be apparent that many modifications can be made thereto without departing from the scope of the invention. Accordingly, the invention is not limited by the foregoing description.

The invention claimed is:

1. A plastic egg carton comprising:

a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a flexible outwardly curved sidewall extending upwardly from the bottom to form a corresponding one of the cells;

the tray having a plurality of cell posts extending upwardly toward the lid above the peripheral edge of the tray, each cell post having a central axis aligned with the height of the carton and being formed at an intersection of four adjacent cells as an extension of the sidewalls of the four adjacent cells;

each cell post having four generally planar ramp surfaces, one disposed respectively on each of the four sidewall extensions between the outwardly curved sidewalls of two adjacent cells, the planar ramp surfaces being aligned at an angle of from about 20 to about 45 degrees relative to the central axis of the cell post; and, the lid having a plurality of lid posts, wherein the cell posts and the lid posts are configured to hold each egg axially aligned with the central axis, each lid post extending downwardly toward the tray and including complementary planar ramp surfaces for mating with the planar ramp surfaces of the cell post when the lid is in the closed position and wherein each lid post includes four downwardly extending fingers, each finger having one of the complementary planar ramp surfaces.

2. The egg carton of claim 1 wherein each cell post has a central dome and wherein the lid post has a complementary crown adapted to receive the dome when the lid is in the closed position.

3. The egg carton of claim 1 wherein each lid post has four contoured surfaces, one between each pair of adjacent fingers, for mating with eggs received within the four adjacent cells when the lid is in the closed position.

4. The egg carton of claim 3 wherein the lid includes a connecting wall between each pair of adjacent lid posts, the connecting wall including a pair of partial ovoid shaped depressions for mating with eggs received in the adjacent cells.

5. The egg carton of claim 4 wherein the ramp angle is from about 30 to about 45 degrees.

6. The egg carton of claim 5 wherein the ramp angle is from about 35 to about 45 degrees.

7. The egg carton of claim 1, wherein the egg carton comprises one of a 2×3, 2×4, 2×5, 2×6, 3×3, 3×4, 3×5, 3×6, 4×4, 4×5, 4×6, 5×5, 5×6 or 6×6 matrix of the cells.

8. A plastic egg carton comprising:

a tray and a lid hingedly connected to the tray for pivoting between open and closed positions, the tray and the lid having respective peripheral edges that mate with each other in the closed position, the egg carton having in the closed position a length, a width and a height;

the tray having a plurality of cells for receiving individual eggs, the cells being arranged successively adjacent each other along the length and width of the carton;

each cell having a bottom and a flexible outwardly curved sidewall extending upwardly from the bottom to form a corresponding one of the cells;

the tray having a plurality of cell posts extending above the peripheral edge of the tray, each cell post having a central axis aligned with the height of the carton and being formed at an intersection of four adjacent cells as a central dome and an extension of the sidewalls of the four adjacent cells, each cell post having four generally planar ramp surfaces, one disposed respectively on each of the four sidewall extensions between the outwardly curved sidewalls of two adjacent cells, the planar ramp surfaces being aligned at an angle of from about 20 to 45 degrees relative to the central axis of the cell post; and the lid having a plurality of lid posts, wherein the cell posts and lid posts are configured to hold each egg axially aligned with the central axis, and each lid post having a complementary crown adapted to receive the cell post dome and having four fingers extending downwardly from the crown for mating with the four sidewall extensions of the cell post respectively when the lid is in the closed position, and wherein each lid post includes four downwardly extending fingers, each finger having one of the complementary planar ramp surfaces.

9. The egg carton of claim 8 wherein each lid post has four contoured surfaces, one between each pair of adjacent fingers, for mating with eggs received within the four adjacent cells when the lid is in the closed position.

10. The egg carton of claim 8 wherein the cell post ramp surfaces are disposed at an angle of from about 20 to about 45 degrees relative to the central axis of the cell post.

11. The egg carton of claim 10 wherein the ramp angle is from about 30 to about 45 degrees.

12. The egg carton of claim 11 wherein the ramp angle is from about 35 to about 45 degrees.

13. A stack of egg cartons comprising a plurality of the egg cartons of claim 1.

14. The stack of claim 13, further comprising a container holding the stack.

15. The stack of claim 14, wherein the container holds a full case or half case of egg cartons.

* * * * *